US005794724A

United States Patent [19]

Moller

[11] Patent Number: 5,794,724

[45] Date of Patent: Aug. 18, 1998

[54] DRILL RIG

[75] Inventor: Karl H. Moller, Westlake, Ohio

[73] Assignee: Diamond Products Joint Venture, Elyria, Ohio

[21] Appl. No.: 744,515

[22] Filed: Nov. 6, 1996

[51] Int. Cl.[6] ..... E21B 7/02

[52] U.S. Cl. ..... 175/170; 175/203; 408/16; 408/76

[58] Field of Search ..... 175/20, 40, 122, 175/170, 203; 408/16, 76

[56] References Cited

U.S. PATENT DOCUMENTS

| | | | |
|---|---|---|---|
| 3,584,534 | 6/1971 | Hougen | 409/191 |
| 3,594,907 | 7/1971 | Schlegel | 33/703 |
| 3,708,020 | 1/1973 | Adamson | 173/7 |
| 3,862,418 | 1/1975 | Preiss | 250/267 |
| 3,899,033 | 8/1975 | Van Huisen | 175/97 |
| 4,260,305 | 4/1981 | Clopton | 409/134 |
| 4,622,751 | 11/1986 | Berg | 33/701 |
| 4,723,868 | 2/1988 | Ferguson | 404/90 |
| 5,038,084 | 8/1991 | Wing | 318/268 |
| 5,058,688 | 10/1991 | Scott et al. | 175/20 |
| 5,076,392 | 12/1991 | Koenig | 181/106 |

OTHER PUBLICATIONS

Diamond Products, Inc. promotional brochure entitled "Core Bore Drilling Machines," 1990 (4 pages).

*Primary Examiner*—Roger J. Schoeppel

*Attorney, Agent, or Firm*—Rankin, Hill, Porter & Clark LLP

[57] ABSTRACT

In a preferred embodiment the core drilling rig of the present invention includes a base, a vertically extending mast, a movable carriage mounted on the mast, an electric powered motor for rotatably driving a core drill bit, and a control system for controlling the supply of electric power to the drive motor. The control system includes a motion sensitive device for detecting the unwanted movement of the base and suspending the supply of electric power to the motor.

14 Claims, 2 Drawing Sheets

DRILL RIG

FIELD OF INVENTION

The invention concerns a portable drill rig for supporting and driving for rotation a core drill bit for use in drilling openings in concrete and related materials. More particularly, the present invention concerns a drill rig for use in core drilling that includes a control system for suspending the operation of the rig upon sensing undesirable motion of the rig's base.

BACKGROUND

Drill rigs for use in core drilling concrete, masonry, stone and similar materials are well-known in the prior art. An example of a prior art core drilling rig is a rig manufactured by Diamond Products of Elyria, Ohio, which is sold under the trade designation "M-2."

Generally, prior art core drill rigs comprise a base, a vertically extending mast, a movable carriage mounted on the mast and an electric powered motor for rotatably driving a core bit. The base usually includes some type of means for securing the rig to the surface of the material that is being drilled. For example, the base may include a vacuum system or a mechanical anchoring system that allows the rig to be temporarily attached to the surface that is being drilled.

No matter what type of means are used to secure the core drilling rig, it is very important that the rig be secured. More particularly, core drilling tends to require a significant amount of torque, and if the base is not securely attached, the base can become free and the entire rig can begin rotating about the core drill bit thereby creating a dangerous condition.

SUMMARY OF INVENTION

The present invention provides a new and improved core drill rig that provides a significant added degree of safety during operation. More particularly, the drill rig of the present invention automatically discontinues operation upon the occurrence of any undesirable movement or motion of the rig's base.

In a preferred embodiment the core drilling rig of the present invention includes a base, a vertically extending mast, a movable carriage mounted on the mast, an electric powered motor for rotatably driving a core drill bit, and a control system for controlling the supply of electric power to the drive motor. The control system includes a motion sensitive device for detecting the unwanted movement of the base and suspending the supply of electric power to the motor.

The foregoing and other features of the invention are hereinafter more fully described and particularly pointed out in the claims, the following description setting forth in detail certain illustrative embodiments of the invention, these being indicative, however, of but a few of the various ways in which the principles of the present invention may be employed.

DETAILED DESCRIPTION

Figure 1:
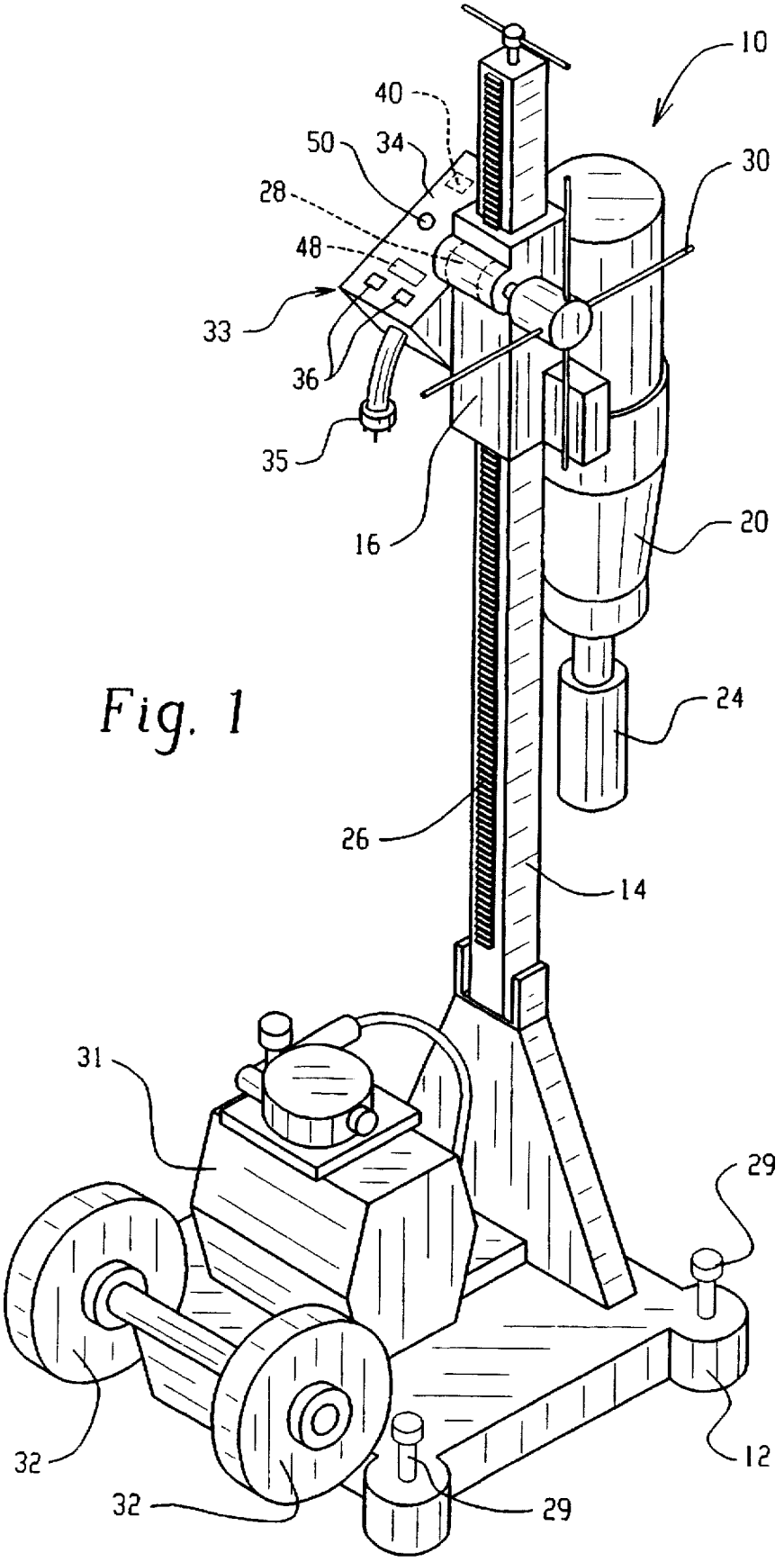
FIG. 1 is a perspective view of a core drilling rig made in accordance with the present invention.

Referring to the drawings, and initially to FIG. 1 there is illustrated a core drilling rig 10 made in accordance with the present invention. Rig 10 is intended for use in core drilling concrete, masonry, stone, rock and similar materials.

As shown in FIG. 1, drill rig 10 includes various features that are common to prior art drilling rigs. More particularly, rig 10 includes a base 12, a vertically extending mast 14, a carriage 16 that is movable along the mast 14, and an electric drive motor 20 that is mounted to the carriage 16. Motor 20 serves to rotatably drive a conventional core bit 24 such as, for example, a diamond core bit sold by Diamond Products of Elyria, Ohio, under the registered trademark CORE BORE. By use of a rack 26 mounted on mast 14 and a pinion gear 28 (shown by hidden lines) the carriage 16 is moved along mast 14 by rotating lever 30 that is connected to the pinion gear 28. The base 12 of the rig 10 includes leveling screws 29, a vacuum system 31 to assist in the secure mounting of the base 12 to the surface of the material that is being drilled and a set of wheels 32 to facilitate the movement of the rig. Mounted on the carriage 16 is an electrical box 33 having a panel 34. Box 33 includes an electrical hook-up 35 and switches 36 for manually controlling the supply of electric power to motor 20 and the vacuum system 32.

The feature that distinguishes rig 10 from prior art drill rigs is that rig 10 includes a control system that automatically suspends the supply of electric power to the motor 20 upon undesirable motion of the base 12. The control system includes a motion sensitive device 40 for sensing the undesirable or unwanted motion of the base 12. Undesirable motion may be defined as the rotation of the base 12 about the bit 24. Alternatively, undesirable motion may be defined as the movement of the base 12 in any direction relative to the surface that is being drilled in excess of about 0.25 inches.

Figure 2:
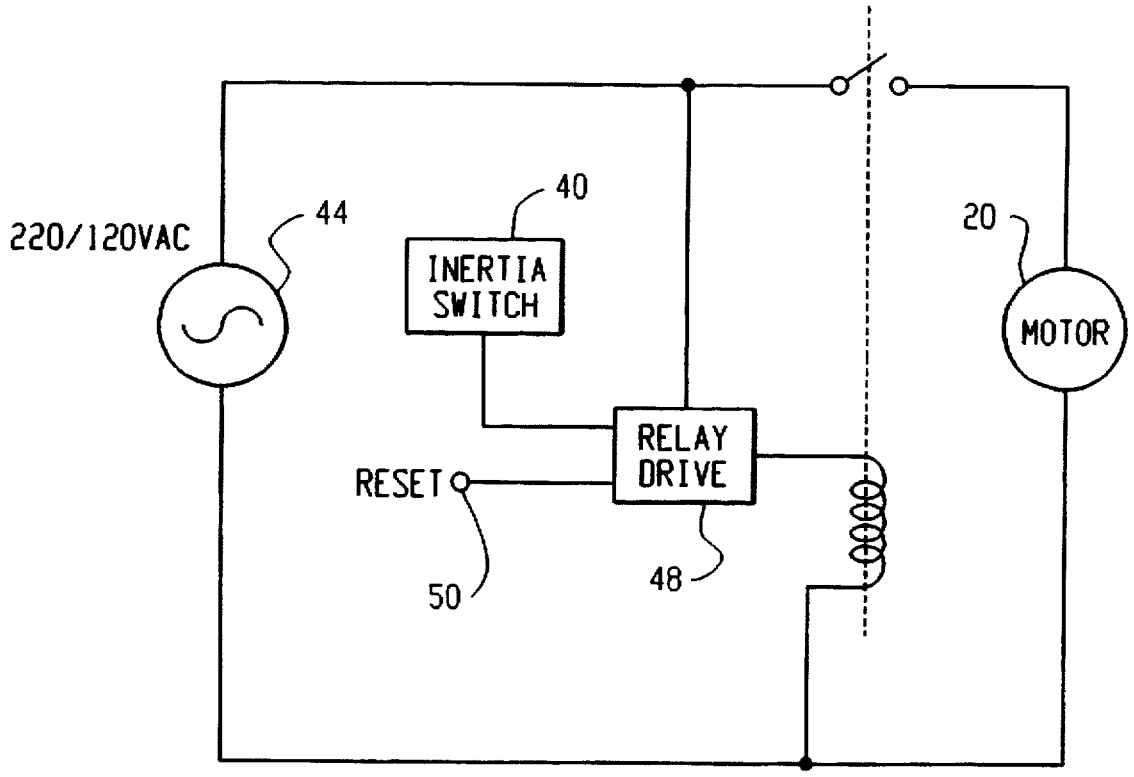
FIG. 2 is a schematic of the electric control circuit for the drilling rig of FIG. 1.

Referring additionally to FIG. 2 the details of the control system will be better understood. More particularly, as shown in FIG. 2 the control system is integrated into the electric circuit which supplies power to the motor 20 from the electrical source 44 (for example a 120 or 240 VAC power source). The system includes the motion sensitive device 40 which is preferably connected to a relay 48 having a reset switch 50. Upon sensing undesirable motion of the base 12 the device 40 triggers the relay 48 thereby suspending the supply of electric power to the motor 20. The switch of relay 48 is reset by reset switch 50 thereby allowing motor 20 to operate until acceleration sensitive device 40 triggers relay 48 open once again. Motion sensitive device 40 and relay drive 48 are preferably mounted within box 33 and reset switch 50 is preferably mounted on panel 34. It will be appreciated that the control system could include a "plugging" circuit that momentarily reverses the supply of current to motor 20 thereby helping to quickly suspend the turning or rotation of the motor.

As shown in FIG. 1, motion sensitive device 40 is preferably mounted on or in the electrical box 33 of the rig. However, it will be appreciated that the device 40 may be mounted on other portions of the rig. The box 33 is a preferred location for device 40 since no additional external wiring is required with this type of mounting. Such external wiring could be damaged or tampered with. However, it will be appreciated that other mounting locations are possible, such as, for example, on the base 12.

Relative to the issue of providing a control system for suspending the supply of electric power to a motor upon the occurrence of unwanted motion, a core drill rig represents a major challenge as compared to other related tools or equipment. More particularly, because a considerable amount of normal vibration and movement is experienced during core drilling, many sensors such as contact switches are not effective. Also, in many environments where core drill rigs are employed, a contact switch will not survive the dust and dirt found in such environments. As to kill switches that require constant engagement by an operator, such switches are easily defeated or disabled by an operator. Quite unexpectedly, however, acceleration sensitive devices have been found to be very useful in the present invention.

Acceleration sensitive devices are capable of sensing motion and acceleration. Such devices may be mounted at various locations on the rig and are not limited to being mounted, for example, on the base. Acceleration sensitive devices are available from various sources including Inertia Switch Incorporated of West Nyack, N.Y. 10994. Such switches are generally the spring-mass type or the magnetic type. These devices are available in various sensing capacities such as unidirectional (sensitivity in one direction), bidirectional (sensitivity in two directions), planar directional (sensitivity in a given plane), hemispherical (sensitive to motion in a given hemisphere) and omnidirectional (sensitivity in any direction). These devices may also be damped. Damping allows the device to disregard usual conditions of vibration or shock.

Whatever acceleration sensitive device is utilized, the device should have a sensitivity of at least about 0.05 g's. Having too low of a sensitivity is a problem because it can lead to the suspension of power to the motor 20 as a result of normal vibration or motion during the drilling operation.

A preferred acceleration sensitive device for use in the present invention is a radial motion/inertia switch sold by Inertia Switch Incorporated under the trade designation 4RO-126. This particular device is capable of sensing acceleration as low as about 0.1 g's.

It will be appreciated that although an acceleration sensitive device is preferred, it may be possible to utilize other devices, such as, for example, proximity sensors, mass sensors, electric eyes and similar devices as the motion sensitive device in order to provide the benefits of the present invention.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed:

1. A drill rig for supporting and driving a core drill bit for drilling openings in concrete and related materials, said drill rig comprising a base, a vertically extending mast, a movable carriage mounted on the mast, an electric powered motor for rotatably driving a core drill bit and a control system for controlling the supply of electric power to said motor, said control system including a motion sensitive device for sensing the unwanted movement of said base and suspending the supply of electrical power to said motor.

2. A drill rig as set forth in claim 1 wherein said motion sensitive device comprises an acceleration sensitive device.

3. A drill rig as set forth in claim 2 wherein said acceleration sensitive device comprises an inertia switch.

4. A drill rig as set forth in claim 2 wherein said acceleration sensitive device comprises a radial inertia switch.

5. A drill rig as set forth in claim 1 wherein said control system includes a resettable relay which opens and suspends the supply of electrical power to said motor upon receipt of a signal from said motion sensitive device.

6. A drill rig as set forth in claim 1 wherein said movable carriage includes a pinion gear and said mast includes a rack along which said pinion gear travels thereby altering the position of said carriage relative to the mast.

7. A drill rig as set forth in claim 1 wherein said control system includes an electrical box to which said motion sensitive device is attached.

8. A drill rig as set forth in claim 7 wherein said motion sensitive device is mounted internally within said electrical box.

9. A drill rig as set forth in claim 1 wherein said control system includes a relay drive which is triggered by said motion sensitive device thereby suspending the supply of electric power to said motor.

10. A drill rig as set forth in claim 9 wherein said control system includes a reset switch for resetting said relay drive.

11. A drill rig as set forth in claim 1 wherein said base includes a vacuum system for anchoring the base to the surface that is being drilled.

12. A drill rig as set forth in claim 2 wherein said inertia switch has a sensitivity of at least 0.005 g's.

13. A drill rig as set forth in claim 1 wherein said unwanted movement comprises the movement of said base relative to said material being drilled in excess of about 0.25 inches.

14. A drill rig as set forth in claim 1 wherein said unwanted movement comprises the rotational movement of said base relative to said core drill bit.

* * * * *